US005097971A

United States Patent [19]

Norris et al.

[11] Patent Number: 5,097,971

[45] Date of Patent: Mar. 24, 1992

[54] STACKABLE AND COLLAPSIBLE SHELF ASSEMBLY

[75] Inventors: Kathleen A. Norris, Lemont; Thomas Hunter, Elmhurst, both of Ill.

[73] Assignee: Selfix, Inc., Chicago, Ill.

[21] Appl. No.: 673,324

[22] Filed: Mar. 22, 1991

[51] Int. Cl.[5] ..... A47F 5/00

[52] U.S. Cl. ..... 211/181; 211/194; 248/175

[58] Field of Search ..... 211/195, 194, 181, 188, 211/198; 108/132; 248/439, 175

[56] References Cited

U.S. PATENT DOCUMENTS

| | | | |
|---|---|---|---|
| 1,700,843 | 2/1929 | Hayward | 211/195 X |
| 2,873,861 | 2/1959 | Jensen | 211/194 X |
| 3,013,670 | 12/1961 | Mayer | 211/181 X |
| 3,848,748 | 11/1974 | Ceccarelli | 211/181 X |
| 4,191,160 | 3/1980 | Elliott | 211/181 X |
| 4,444,320 | 4/1984 | Chap | 211/194 X |
| 4,732,284 | 3/1988 | Remmers | 211/188 |
| 4,953,473 | 9/1990 | Tomaka et al. | 248/439 X |

*Primary Examiner*—Robert W. Gibson, Jr.

*Attorney, Agent, or Firm*—Dressler, Goldsmith, Shore, Sutker & Milnamow, Ltd.

[57] ABSTRACT

A coated wire shelf assembly capable of free standing support and collapsible to a reduced size to facilitate shipping and storage thereof. The shelf assembly includes a shelf and a pair of laterally spaced shelf supports connected by hinge joints to the shelf. Separate locking mechanisms releasably secure each shelf support in a shelf supporting position and allows each shelf support to be rotated about a respective hinge joint to a storage position to substantially reduce the size of the shelf assembly thereby facilitating shipping and storage thereof.

17 Claims, 2 Drawing Sheets

STACKABLE AND COLLAPSIBLE SHELF ASSEMBLY

TECHNICAL FIELD OF THE INVENTION

The present invention generally relates to plastic-coated wire structures and, more particularly, to a plastic-coated wire shelf assembly which is capable of stacking on a like shelf assembly or collapsing to a substantially reduced size to facilitate shipping and storage thereof.

BACKGROUND OF THE INVENTION

Plastic-coated metal wire structures have become very popular consumer items. A wide variety of such products are available, including shelves, racks, baskets, and like arrangements, which facilitate convenient storage of articles where desired. Because various colors and types of plastic coatings can be applied to such structures, they can be used in a myriad of locations throughout the home.

Because of their light weight, strength and durability, baskets, shelves, and racks formed of coated wire material have proven convenient and useful, particularly around the home. One type of such a coated wire product is a shelf which is suitable for use in the kitchen, bathroom, and other areas where there is a need for shelving to store or stack various articles. While some metal wire shelves may be affixed to a wall, others are adapted to be free standing and may be placed in cabinets, pantries, closets, or the like.

Wire structure shelving units come in a variety of shapes and sizes. U.S. Pat. No. 4,444,320 to J. P. Chap discloses a stackable shelf unit formed of wire coated material. Such a shelf unit readily lends itself to various uses, such as for supporting a variety of containers, articles, or boxes thereon.

One desirable feature of a free standing shelf is the capability of the shelf to stack upon a like shelf and preferably interlock therewith. The ability to stack the shelves upon each other allows a user to efficiently make use of space at a selected location and readily arrange the shelves into a multi-tiered arrangement. This feature allows the user to "customize" shelf arrangements. As will be understood, the ability to interlock the shelves with each other reduces the likelihood that they will separate, e.g., and fall when the containers or articles stored thereon are slidably removed from the shelf.

The ability to effect compact storage of a shelf when not in use is another desirable feature. Compact storage is an important consideration during shipment where volume of the item to be shipped is usually directly related to shipping costs. Compact storage of a shelf will likewise enhance inventory and storage. While the ability to "nest" such wire shelf structures within each other is advantageous, the ability to further reduce the shipping size of such shelf structures would provide further benefits.

Thus, there is a need and a desire for a coated wire shelf structure which is capable of interlocking with a like shelf structure and yet is collapsible upon itself to minimize its size thereby facilitating shipping and storage thereof.

SUMMARY OF THE INVENTION

In accordance with the present invention, there is provided a shelf assembly, typically made of coated wire, capable of free standing support, which is collapsible to a reduced size to facilitate shipping and storage thereof. The shelf assembly of the present invention includes a shelf having a plurality of parallel laterally spaced and joined shelf members defining a supporting surface and a pair of laterally spaced shelf supports rotatably connected to the shelf. Locking mechanisms releasably lock the shelf supports in a shelf supporting position generally transverse to the supporting surface. When released, each of the shelf supports is rotatable to a storage position adjacent the supporting surface to substantially reduce the size of the shelf assembly thereby facilitating shipping and storage thereof.

Each shelf support includes a length of metal wire, which combines with the wire structure of the shelf to form a hinge joint pivotally connecting the shelf support to the shelf. The hinge joint also includes a pivot member which extends generally parallel to and is located at opposite ends of the shelf supporting surface to permit arcuate movement of a respective shelf support relative to the shelf through an angle of about 90°. The hinge joint is configured to minimize projections from either side of the shelf supporting surface and thereby economize on the storage size of the shelf assembly.

More specifically, each shelf support takes the form of a generally U-shaped single length of metal wire having leg portions and a support or foot portion. The free ends of the metal wire have eyelets configured to accommodate and allow a wire structure or pivot member disposed below and attached to the shelf to pass therethrough to form the hinge joint. Such a design provides a substantially clear and generally planar shelf supporting surface for the shelf assembly by maintaining the shelf supports below the shelf supporting surface in both the shelf supporting and collapsed positions. To promote stability for the shelf assembly when the shelf supports are locked in a shelf supporting position, the generally horizontal foot or support portion of each shelf support is extends laterally outwardly from the shelf assembly. The foot or support portion of the shelf support promotes stability upon stacking of a shelf assembly vertically one upon the other.

The leg portions of each U-shaped shelf support are resiliently flexible and join the support portion to pivot member at the hinge joint. Each leg portion is configured to normally position the support portion laterally outward of a vertical plane passing through the corresponding pivot member and the hinge joints to establish an outwardly directed resilient force which holds the support portion in interlocking engagement with a like shelf assembly therebelow.

The locking mechanism for releasably locking a shelf support in a supporting position preferably includes a wire locking member extending across opposite ends and beneath the supporting surface of the shelf. The locking member is configured to releasably entrap an upper end of each leg portion in a manner inhibiting pivotal movement of the shelf support about a respective hinge joint. The locking mechanism further provides a surface on which another shelf assembly is supported in a vertical stacking relationship therewith.

The shelf assembly is preferably fabricated from vinyl or plastic-coated metal wire for corrosion resistance and in a pleasing resilient finish. When the shelf supports are in their shelf supporting position, they depend from the shelf and can be interconnected to a like shelf assembly to provide customized storage solutions throughout the household.

When not in use, the shelf assembly of the present invention may be collapsed to a substantially reduced size. As indicated above, the leg portions of each shelf support are normally resiliently biased into engagement with the locking mechanisms. The leg portions of each shelf support are released from entrapment with their respective locking mechanism by sliding the free ends of the leg portions inwardly along the corresponding pivot member until they are clear of the locking mechanism. Each shelf support can then be rotated about a respective hinge joint to a storage position in which it lies underneath and generally parallel to the supporting surface to minimize the size of the collapsed shelf assembly.

Numerous other features and advantages of the present invention will become readily apparent from the following detailed description of the invention and an embodiment thereof, from the claims, and from the accompanying drawings in which the details of the invention are fully and completely disclosed as a part of this specification.

DETAILED DESCRIPTION OF A PREFERRED EMBODIMENT

Figure 1:
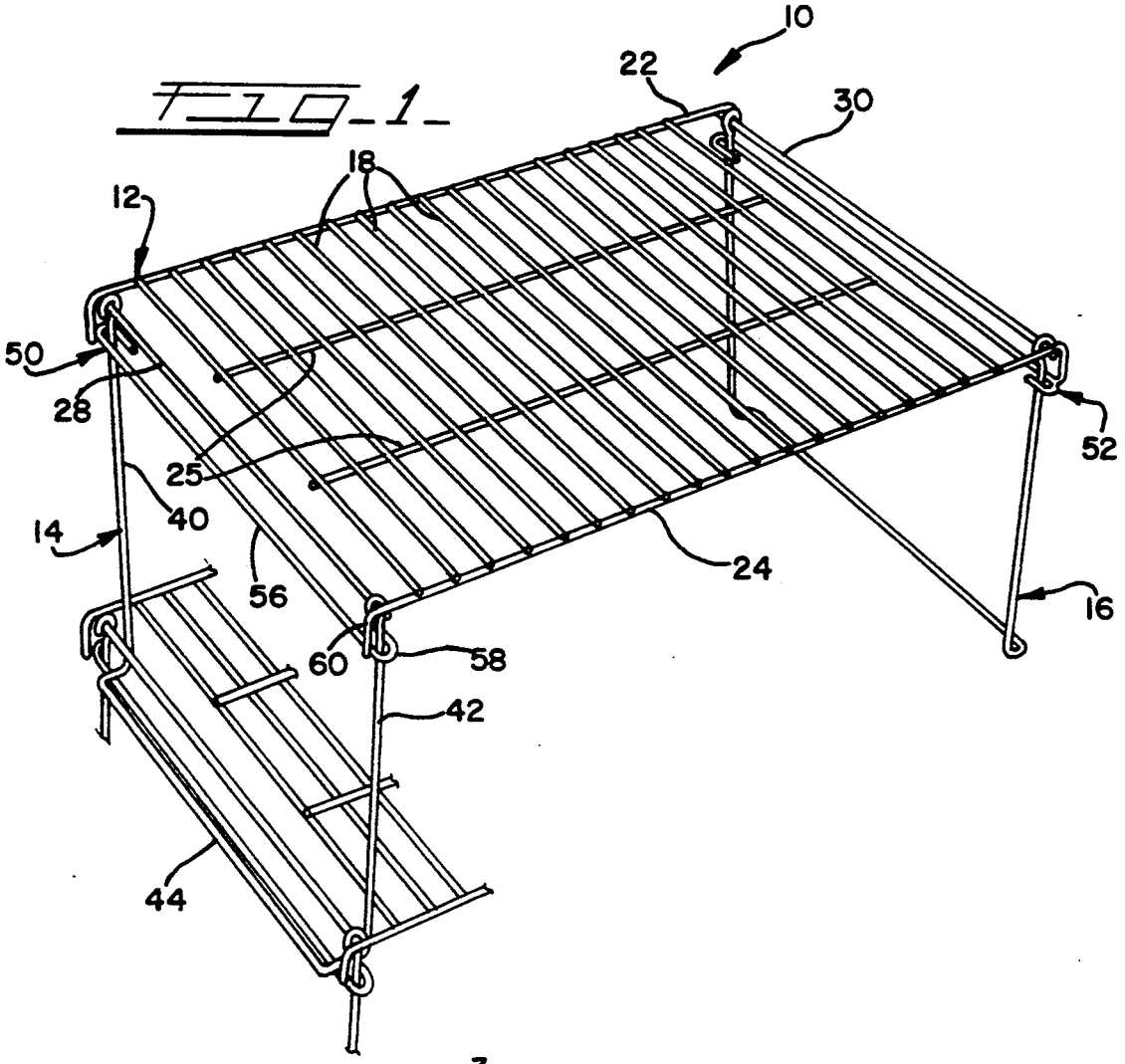
FIG. 1 is a perspective view of a shelf assembly incorporating the present invention shown stacked upon a fragmentary showing of a like shelf assembly.

While the present invention is susceptible to embodiment in various forms, there is shown in the drawings, and will hereinafter be described, a presently preferred embodiment, with the understanding that the present disclosure is to be considered as an exemplification of the principles of the present invention and is not intended to limit the invention to the specific embodiment illustrated.

Referring now to the drawings, wherein like reference numerals indicate like parts throughout the several views, there is shown a shelf assembly 10 including a shelf 12 and a pair of laterally spaced shelf supports 14 and 16 which are connected near opposite ends of the shelf 12. Preferably, shelf 12 and supports 14, 16 are fabricated from plastic coated metal wire members which are appropriately shaped to form the assembly of the present invention in its desired configuration.

The shelf assembly is fabricated with known methods typically comprising suitable interconnection of the various members, such as by welding, with the entire assembly thereafter being coated. The plastic coating may comprise vinyl or a like material which is suitably durable and corrosion resistant, and which is typically available in a wide variety of colors for enhancing the aesthetic appeal of the resultant product. Alternatively, the shelf assembly may be plated with a suitable metal coating in lieu of the plastic coating. The shelf 12 and supports 14, 16 may also be molded and thereafter connected together. If molded, multiple elements may be molded as a unitary component rather than welding the various elements together to form the assembly.

In the illustrated embodiment, shelf 12 has a generally rectangular configuration and includes a plurality of generally parallel laterally spaced and joined shelf members 18 which combine to define a supporting surface 20. The opposite ends of the shelf members 18 are connected to a frame comprised of a pair of spaced apart, laterally extending, generally parallel left and right wire frame members 22, 24. The supporting surface 20 of shelf 12 may also include one or more stiffening members 25 attached to and extending across a number of shelf members 18 intermediate their ends.

The shelf supports 14, 16 are rotatably connected near opposite lateral ends of the shelf 12 to pivot members or rods 28, 30. Each pivot rod 28, 30 extends generally parallel to and is either coplanar with or spaced slightly beneath the supporting surface 20 to allow rotation of a respective shelf support 14, 16, respectively, relative thereto. In the illustrated embodiment, each pivot rod 28, 30 permits rotation of a respective shelf support 14, 16 beneath and relative to the shelf 12 through an angle of about 90°.

In the illustrated embodiment, the shelf supports 14, 16 are mirror images of each other. Accordingly, only shelf support 14 and its connection to pivot rod 28 will be discussed in detail with the understanding that shelf support 16 and pivot rod 30 are substantially similar in construction.

Figure 2:
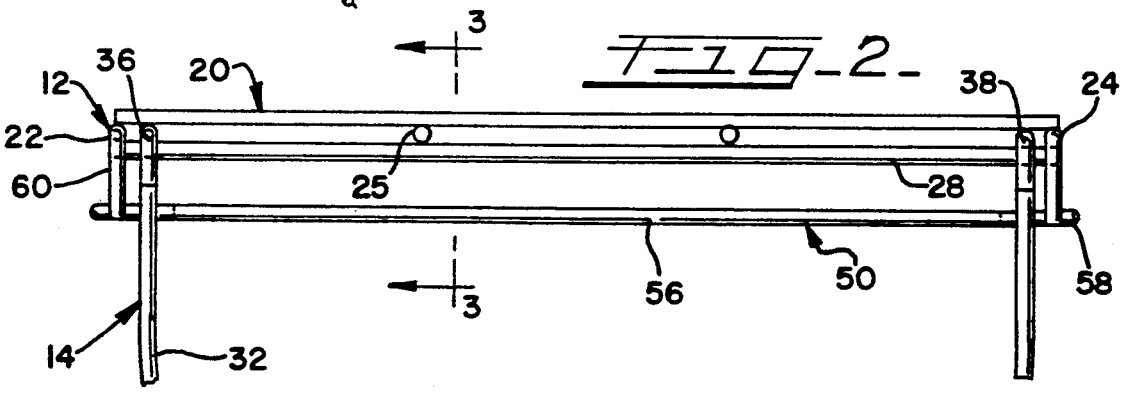
FIG. 2 is a fragmentary enlarged end view of the shelf assembly showing a shelf support therefor in a shelf supporting position.
Figure 2:
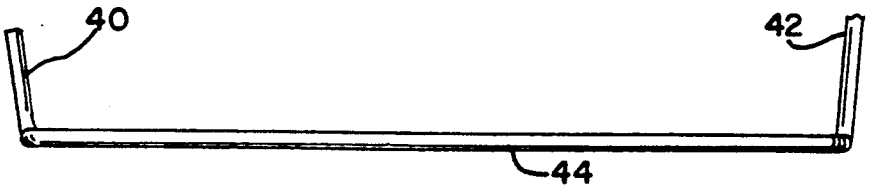

As seen in FIG. 2, the shelf support 14 is comprised of a single piece of metal wire 32 which is pivotally connected to the pivot rod or wire member 28, which, as indicated above, extends between and is secured to the left and right frame members 22 and 24 adjacent the ends thereof. In the preferred embodiment, the metal wire 32 forming the shelf support 28 is generally U-shaped. The free ends of the metal wire 32 are configured as eyelets 36, 38 which receive and are pivotally or rotatably supported by wire member or pivot rod 28.

Figure 3:
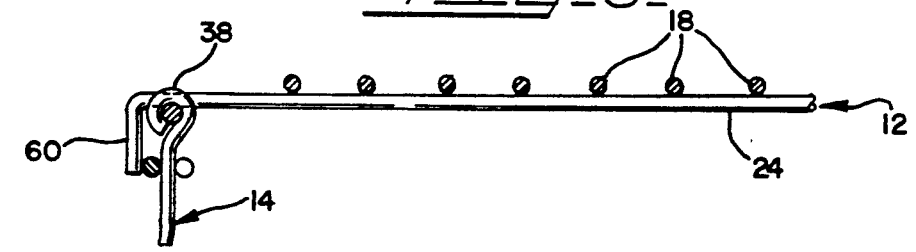
FIG. 3 is a fragmentary enlarged front elevational view of an end of the shelf assembly of FIG. 1 showing the shelf support in its shelf supporting position.
Figure 3:
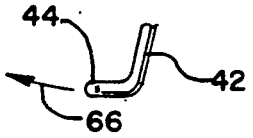
Figure 4:
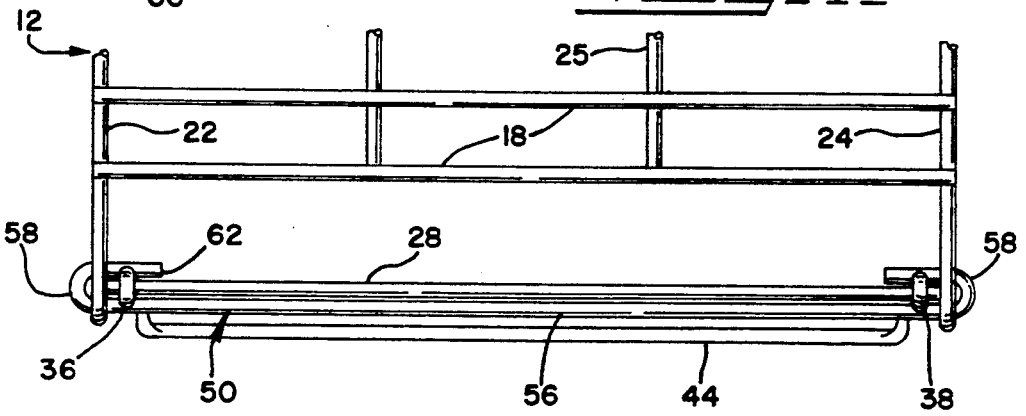
FIG. 4 is a fragmentary plan view of an end of the shelf assembly with the shelf support releasably locked in a shelf supporting position.

As shown in FIG. 2, the metal wire 32 of the shelf support 14 includes a pair of resiliently flexible left and right leg portions 40, 42 which are integral with and extend between the left and right eyelets 36 and 3 formed integrally therewith and the free ends thereof, to a bottom portion 44, formed at the lower ends thereof. As seen in FIGS. 3 and 4, the bottom portion 44 extends transversely to the plane of the leg portions 40, 42 to define a foot portion which adds free standing stability to the shelf assembly.

Figure 5:
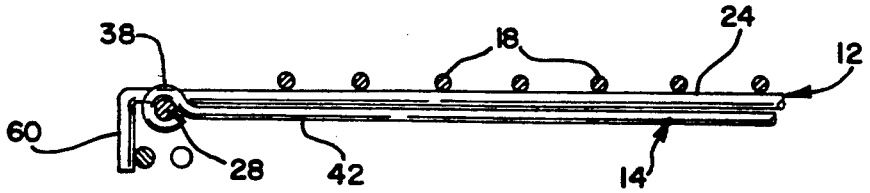
FIG. 5 is a fragmentary enlarged front elevational view of an end of the shelf assembly of FIG. 1 showing the shelf support in its storage position.

The shelf assembly is furthermore provided with shelf support locking members 50 and 52. Each locking member 50, 52 releasably locks a respective shelf support 14, 16 in a shelf supporting position in which the shelf supports 14, 16 depend from the shelf 12. When released, each of the shelf supports 14, 16 can be rotated about the respective pivot rods 28, 30 from its supporting position (FIGS. 1–4) to a storage position (FIG. 5). In both the shelf supporting and collapsed or storage positions, the shelf supports 14, 16 are arranged beneath, and provide a substantially clear, shelf supporting surface 20.

The locking members 50, 52 are mirror images of each other. Accordingly, only locking member 50 is described below in detail with the understanding that locking member 52 is constructed substantially similar thereto.

The locking member 50 is positioned at the end of and beneath the support surface of shelf 12. In the illustrated embodiment, each locking member 50 includes a central bracing portion 56 and end hook portions 58 which are configured to releasably entrap an upper end of each leg portion 40, 42 of the shelf support 14 in a manner inhibiting pivotal movement of the shelf support about its respective pivot rod 28.

As shown in FIGS. 1, 2, and 3, the free end 60 of each shelf frame member 22, 24 is bent downwardly depending 58 extending beneath the support surface 20. The locking member 50 is secured to the depending ends 60 of the frame members 22, 24 and, extends therebetween. Each hook end 58 of the wire locking member 50 defines elongated open-ended locking channel 62 (See FIG. 4). Each locking channel 62 is generally vertically aligned with the pivot rod 28 disposed thereabove. The channel 62 is appropriately sized to releasably entrap an upper end of the resilient leg portions 40, 42 of the shelf support 14 therein to inhibit rotational movement of the leg portions. In a preferred form of the invention, the locking channel has a width equal to or slightly greater than the cross-sectional thickness of the upper end of the leg portion on each shelf support.

When the shelf supports 14, 16 are locked in their shelf supporting position, the leg portions thereof normally position the respective foot portion 44 outwardly of a vertical plane passing through the respective hinge rod 28. As depicted in FIG. 2, the leg portions 40 and 42 slightly converge toward each other such that the width of the foot portion 44 is somewhat less than the distance separating the eyelets 36 and 38. Such configuration facilitates interconnecting like shelf assemblies when vertically stacked upon each other.

To facilitate stacking of the shelf assemblies upon each other, and as depicted in FIG. 4, the outermost shelf member 18 is laterally spaced inwardly from pivotrods 28, 30 a distance sufficient to allow the foot portion 44 of another shelf support 12, 14 to pass therebetween.

The central portion 56 of the locking member 50 acts as a support for the foot portion 44 of another shelf assembly allowing it to be stacked thereupon. Configuring the leg portions 40 and 42 such that the foot portion 44 extends laterally outward, when combined with arranging the locking rod 50 in general vertical alignment with the hinge rod 28, 30, facilitates locking engagement of vertically stacked shelf assemblies by imparting a outwardly directed bias force to the foot portion 44 of each shelf support 14, 16 in the direction of arrow 66 (FIG. 3) when the shelf supports are in shelf supporting position.

Overall resiliency of each shelf support coupled with the elongation and resiliency of the leg portions 40 and 42 allows each shelf support 44 to be quickly and readily locked in a shelf supporting position with minimum effort and time. Moreover, the resilient nature of the plastic coating on the wires enhances engagement between the wire structures so as to facilitate the locking relationship between the wires when the shelf support is moved into a shelf supporting position.

When it is desired to store the shelf assembly 10 of the present invention, the leg portions 40, 42 are quickly and readily collapsible. As will be understood, the resiliency of the leg portions 40 and 42 allows them to be moved inwardly towards each other along pivot rod 28 and released from within the locking channels 62 of the respective hook ends 58. The support shelf supports 14, 16 may thus be pivoted about the respective hinge rods 28, 30. Accordingly, as illustrated in FIG. 5, the shelf support may be rotated about their respective hinge rod into a position extending substantially parallel to the support surface of the shelf.

Thus, there has been disclosed a conveniently stowable shelf assembly capable of being easily and rapidly erected and used and is likewise capable of compact storage without requiring significant space allocations or the use of tools. Notably, the shelf supports are configured to establish a resilient force facilitating interconnection of the shelf assemblies when stacked upon each other. Moreover, by arranging the hinge rods, locking mechanisms, and shelf supports beneath the shelf 12, a clear and unobstructed support surface is provided for each shelf assembly.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A free standing shelf assembly comprising:

a shelf having a plurality of generally parallel laterally spaced support members defining a supporting surface;

a pair of laterally spaced shelf supports, each shelf support having leg portions pivotally connected to the shelf and being rotatable relative to said shelf, each of said shelf supports including a supporting foot portion extending laterally outwardly therefrom and generally transverse to the plane of said shelf support; and means for releasably locking each shelf support in a shelf supporting position generally transverse to the plane of said supporting surface, said locking means being disposed beneath said supporting surface for engaging said leg portion of each shelf support to inhibit rotation thereof and for allowing release of said leg portion from said shelf supporting position and rotation thereof relative to said shelf to a storage position lying beneath and generally parallel to the supporting surface to substantially reduce the size of said shelf assembly to facilitate shipping and storage thereof.

2. The free standing shelf assembly according to claim 1 wherein each shelf support is generally U-shaped in configuration with free ends thereof configured to pivotally engage a pivot member on said shelf.

3. The free standing shelf assembly according to claim 2 wherein said pivot member on said shelf is disposed below said supporting surface.

4. The free standing shelf assembly according to claim 1 wherein said leg portions of each said shelf support are joined to said foot portion thereof and are pivotally connected to a pivot member on said shelf, each said leg portion being resiliently flexible and configured to normally position said foot portion laterally outward of a vertical plane passing through the respective pivot member to establish a resilient force releasably holding the foot portion in engagement with a like shelf assembly when said shelf supports are locked in a shelf supporting position.

5. The free standing shelf assembly according to claim 1 wherein each locking means further defines a support beneath the supporting surface of said shelf for a foot portion of a shelf support of a like shelf assembly vertically stacked thereabove.

6. The free standing shelf assembly according to claim 1 wherein said shelf and the shelf supports connected thereto comprise plastic coated wire members.

7. A free standing shelf assembly comprising:

a shelf having a plurality of generally parallel laterally spaced support members defining a supporting surface;

a pair of laterally spaced shelf supports, each shelf support having leg portions pivotally connected to the shelf and being rotatable relative to said shelf; and means for releasably locking each shelf support in a shelf supporting position generally transverse to the plane of said supporting surface, said locking means being disposed beneath said supporting surface for engaging said leg portion of each shelf support to inhibit rotation thereof and for allowing release of said leg portion from said shelf supporting position and rotation thereof relative to said shelf to a storage position lying beneath and generally parallel to the supporting surface to substantially reduce the size of said shelf assembly to facilitate shipping and storage thereof, each locking means including a bent wire member defining an elongated open-ended channel releasably accommodating a leg portion of a shelf support therewithin.

8. The free standing shelf assembly according to claim 7 wherein said leg portions of each said shelf support are normally biased into engagement with said locking means when said shelf support is in said supporting position.

9. The free standing shelf assembly according to claim 8 wherein said shelf and the shelf supports connected thereto comprise plastic coated wire members.

10. A free standing shelf assembly comprising:

a shelf having a plurality of generally parallel laterally spaced support members defining a supporting surface;

a pair of laterally spaced shelf supports, each shelf support having leg portions pivotally connected to the shelf, said shelf supports being rotatable relative to said shelf between a shelf supporting position generally transverse to the plane of said supporting surface and a storage position adjacent to and beneath the supporting surface to substantially reduce the size of said shelf assembly to facilitate shipping and storage thereof; and means for stopping each of said shelf supports in said shelf supporting position and for releasably locking each of said shelf supports in said shelf supporting position, said stopping and locking means being disposed beneath said supporting surface for engaging said leg portions of each of said shelf supports to stop rotation thereof in said shelf supporting position and to inhibit rotation thereof out of said shelf supporting position, said stopping and locking means being operable to allow release of each of said leg portions from said shelf supporting position and rotation thereof to a storage position.

11. The free standing shelf assembly according to claim 10 wherein:

said shelf includes a pair of spaced apart frame members oriented generally transverse to said support members and connected to the opposite ends thereof.

12. The free standing shelf assembly according to claim 11 wherein:

the opposite end portions of said frame members extend downwardly in a direction substantially transverse to the plane of said supporting surface.

13. The free standing shelf assembly according to claim 12 including:

a pivot member connected to each of said frame members adjacent to said end portions oriented generally parallel to said support members and disposed below said supporting surface.

14. The free standing shelf assembly according to claim 13 wherein the free ends of said leg portions of each of said shelf supports are pivotally connected to one of said pivot members.

15. The free standing shelf assembly according to claim 14 wherein:

said stopping and locking means comprises a bent wire member defining an elongated open ended channel connected to said end portions of said frame means and spaced below said pivot member.

16. The free standing shelf assembly according to claim 15 wherein the pivotally connected free ends of said leg portions of each said shelf support are translatable along said pivot member for selective engagement within said open ended channel of said stop and locking means and are selectively retainable therein to inhibit rotation thereof from said shelf supporting position.

17. The free standing shelf assembly according to claim 16 wherein said ends of said leg portions are resiliently biased into said open ended channels.

* * * * *